US006565168B1

(12) United States Patent
Baliko

(10) Patent No.: US 6,565,168 B1
(45) Date of Patent: May 20, 2003

(54) FITTINGS WITH A DISTENDIBLE GUIDE FOR DRAWERS OR THE LIKE

(75) Inventor: Karl Baliko, Meiningen (AT)

(73) Assignee: Julius Blum Gesellschaft m.b.H., Höchst (AT)

( * ) Notice: Subject to any disclaimer, the term of this patent is extended or adjusted under 35 U.S.C. 154(b) by 0 days.

(21) Appl. No.: 09/831,626

(22) PCT Filed: May 30, 2000

(86) PCT No.: PCT/AT00/00074

§ 371 (c)(1),
(2), (4) Date: May 11, 2001

(87) PCT Pub. No.: WO00/59343

PCT Pub. Date: Oct. 12, 2000

(30) Foreign Application Priority Data

Mar. 31, 1999 (CH) ..... 613/99

(51) Int. Cl.[7] ..... A47B 88/04
(52) U.S. Cl. ..... 312/334.12; 312/331
(58) Field of Search ..... 312/330.1, 331, 312/334.1, 334.7, 334.8, 334.9, 334.12, 334.16, 334.18, 334.21; 384/19, 20

(56) References Cited

U.S. PATENT DOCUMENTS 1,758,550 A * 5/1930 Wolters ..... 312/331
3,794,401 A * 2/1974 Dean et al. ..... 312/331 X
4,436,989 A 3/1984 Schuldt
4,910,916 A * 3/1990 Dubach et al. ..... 312/331 X

FOREIGN PATENT DOCUMENTS

| | | | |
|---|---|---|---|
| DE | 344418 | * 11/1921 | ..... 312/334.12 |
| DE | 1964240 | 6/1971 | |
| DE | 2306466 | 8/1974 | |
| DE | 2328506 | 1/1975 | |
| EP | 0829213 | 3/1998 | |

* cited by examiner

*Primary Examiner*—James O. Hansen
(74) *Attorney, Agent, or Firm*—Wenderoth, Lind & Ponack, L.L.P.

(57) ABSTRACT

A pull-out guide assembly for a drawer comprises a first body rail, a second body rail, a first moveable rail, a second moveable rail, a first support roller mounted on the first body rail, a second support roller mounted on the second body rail, a first running roller mounted on the first moveable rail, and a second running roller mounted on the second moveable rail. The first and second body rails each have a U-shaped section including an upper web and a lower web, and the first running roller is adapted to be guided in the U-shaped section of the first body rail so as to run on the upper web or lower web thereof, and the second running roller is adapted to be guided by the U-shaped section of the second body rail so as to run on the upper web of the lower web thereof. The first running roller and the second running roller are non-rotationally connected to each other.

11 Claims, 3 Drawing Sheets

FITTINGS WITH A DISTENDIBLE GUIDE FOR DRAWERS OR THE LIKE

BACKGROUND OF THE INVENTION

The present invention relates to a pull-out guide fitting for drawers or the like, having a body rail, a drawer rail, and optionally an intermediate rail, on both sides of the drawer. Support rollers are mounted on the body rails and running rollers are mounted on the drawer rails and the intermediate rails. The running rollers are guided in U-shaped sections of the body rails and run on lower and/or upper horizontal webs of the body rails.

Drawer pull-out arrangements of this type comprise rails which are attached to the drawer and/or furniture body and along which the running rollers, optionally with a tilting function, and the support rollers of the drawer are guided during a pulling out movement of the drawer. The drawer disclosed in EP 820 712 A2, for example, discloses such a pull-out arrangement.

When a drawer is pulled out from a furniture body, its guide loses lateral stability the further the drawer is pulled out. In a pulled-out state, a distance between the supporting rollers and the running rollers with a tilting function is small, so that a lever action takes place. The small distance, with respect to a running direction and cabinet depth or pull-out depth, between the rollers in operation reduces lateral stability of the pulled-out drawer. The lateral stability is determined by actual roller clearance and a possibility of moving each individual side of the drawer freely with respect to its pull-out depth, in which case because of easy lateral pivoting movement the rollers on one side of the drawer turn in an opposite direction relative to the rollers on the opposite side of the drawer. A possible pivoting clearance of the pulled-out drawer is additionally increased as a structural width of the drawer becomes larger.

An already known method of preventing this clearance with toothed racks and toothed wheels engaging on both sides of the drawer has a drawback in that because of a tooth clearance a pivoting clearance nevertheless remains.

SUMMARY OF THE INVENTION

An object of the invention is to increase lateral stability of a drawer that is pulled-out partially or completely by substantially preventing a horizontal pivoting clearance.

Desired improvement of lateral stability is achieved according to the invention in that at least two running rollers arranged on mutually opposite sides of the drawer are connected to each other in a non-rotational manner.

When a drawer with a pull-out arrangement according to the invention is pulled out, a lever function takes place, with supporting and tilting forces being directed by way of running rollers. A connection preventing rotation, preferably a tube or a rod, which is fixed for example by wedge connections to the running rollers and results in synchronization of rotation of the running rollers about their axis, is provided between the running rollers under lever loading in a pulled-out state of the drawer. Accordingly, clearance is no longer present as a result of opposite rotation of the running rollers. Under normal pre-conditions lever loading of a pulled-out drawer upon the running rollers is sufficient to suppress a lateral slipping between a running face and the running roller. The drawer is thus held in a pulled-out position without pivoting laterally. Slipping is also suppressed when the drawer is partially pulled out, as soon as gripping friction between the running rollers and a guide path, on account of contact pressure, is sufficient to withstand shear forces resulting from a pivoting load. The drawer is likewise held in position, when it is pulled out, obliquely offset to a certain degree.

It is advantageous to provide the running rollers and/or the guide paths with gripping-assisting surfaces, such as for example in the case of quiet-running rollers.

BRIEF DESCRIPTION OF THE DRAWINGS

The invention is explained in greater detail by way of example with reference to drawings.

DETAILED DESCRIPTION OF THE PREFERRED EMBODIMENTS

Figure 1:
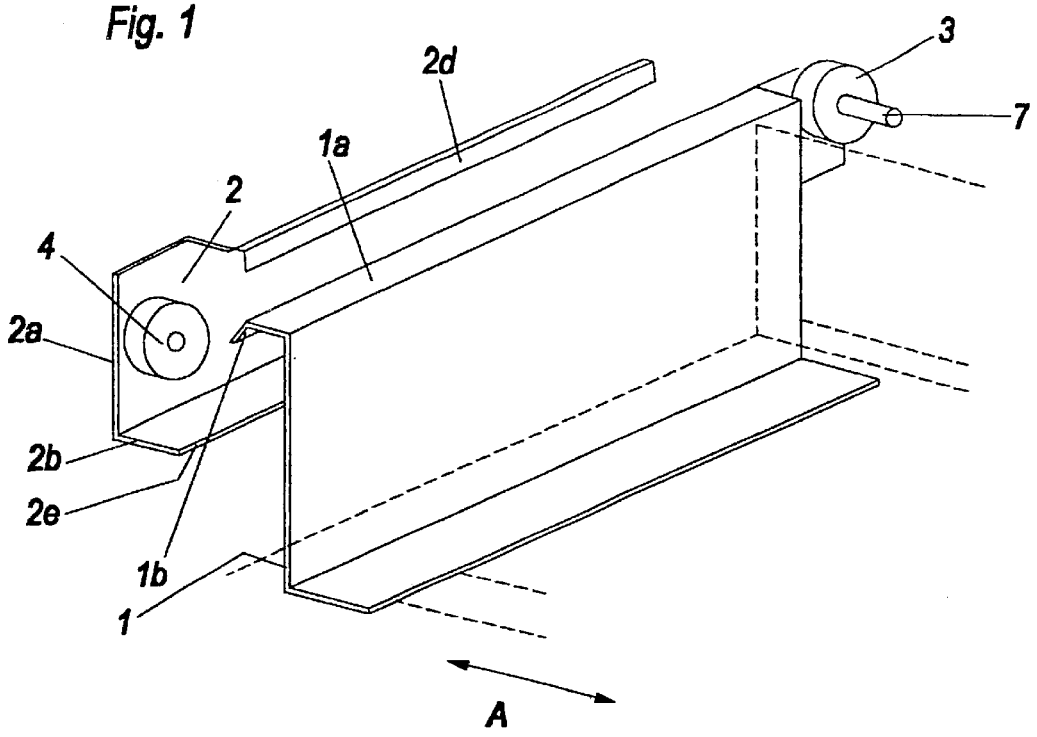
FIG. 1 is an illustration of one side of a dismantled drawer pull-out arrangement according to the invention.

FIG. 1 is an illustration of a dismantled drawer pull-out guide with a drawer rail 1 which is attached to each side of a drawer, indicated in broken lines, and a body rail 2 which is attached to the furniture body at each side of the drawer. The body rail 2 is approximately U-shaped, with one web of the U being designed as an assembly edge 2*a* for being fastened to an inner face of the furniture body, and two horizontal webs 2*b* and 2*c* being designed as running faces for a running roller 3. A horizontal web 1*a* of the drawer rail 1 acts as a running face for a support roller 4. If the drawer is now pulled out of the furniture body the running roller 3 is guided inside the body rail 2 and between the two horizontal webs 2*b* and 2*c*, with the running roller 3 running on lower horizontal web 2*b* at the beginning of the pullout movement, but acts as a tilting roller as the pull out movement increases, and is pressed upwards above the drawer rail 1 as a function of gravity by weight of the drawer and then rolls on upper horizontal web 2*c* as the pull-out movement continues. Each running roller 3 is guided laterally by guide projections 2*d* and 2*e*. A guide projection 1*b* rests laterally against the support roller 4.

A pulled out drawer is pressed downwards as a function of gravity and tilts about an axis formed by the support rollers 4, as a result of which each running roller 3 is pressed against its respective upper horizontal web 2*c*. A connecting rod 7 attached between the running rollers 3 in a manner so as to prevent rotation causes a synchronization of rotation of the two running rollers 3, as a result of which rotation of the two running rollers 3 in opposite directions is prevented. In this way, when pressure is exerted along the pivot axis A opposed movements of travel of sides of the drawer are prevented in accordance with magnitude of gripping forces. Considerable lever forces when the drawer is in a pulled-out state results in such a strong gripping of each running roller 3 on its respective running face that it is possible to withstand strong shear forces resulting from a pivoting movement of the drawer. This gripping friction, occurs as soon as the drawer tilts and the running rollers 3 roll on the respective upper horizontal webs 2*c*, irrespectively of whether the drawer has been pulled out completely or only partially. The drawer is thus held in a pulled out position, which can also be offset obliquely to a certain degree, provided that the guide rails permit it. In addition, lateral stability is directly increased by increasing a weight loading of the drawer.

Figure 2:
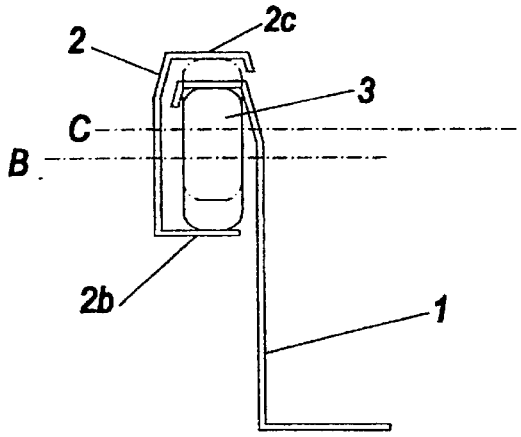
FIG. 2 is a sectional view of two guide rails with a running roller.

FIG. 2 is a sectional view of a drawer pull-out guide, in which B indicates an axial position of the running rollers 3 at the beginning of a pull-out movement, and C represents an axial position of the running rollers 3 whilst rolling over respective upper horizontal webs 2*c*, i.e. on upper running faces.

Figure 3:
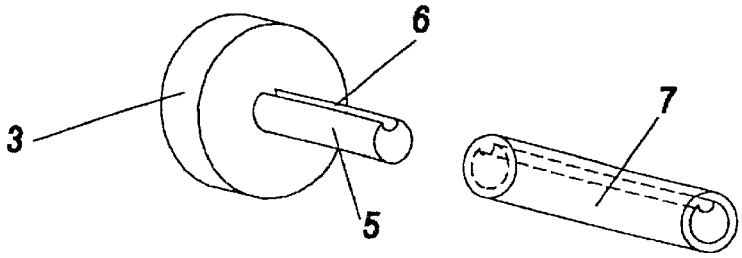
FIG. 3 is an illustration of a dismantled running roller according to the invention, showing a connecting pin and a connecting rod.
Figure 4:
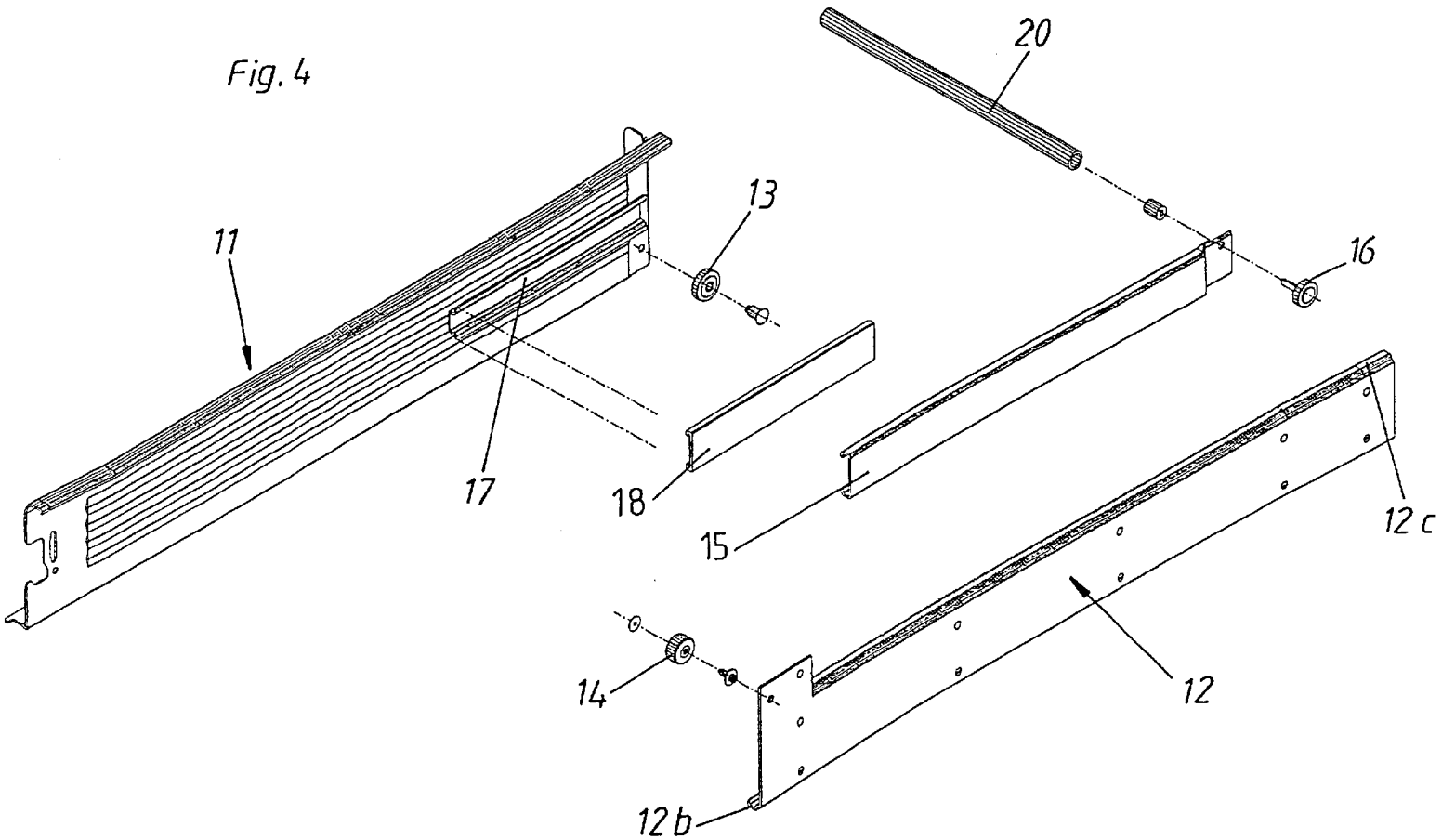
FIG. 4 is an exploded view of one side of a drawer pull-out arrangement according to a further embodiment of the invention.
Figure 8:
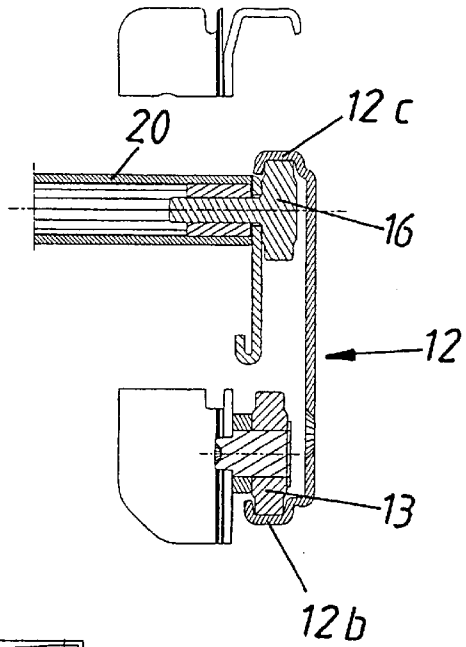
FIG. 8 is a sectional view along line B—B in FIG. 5.
Figure 7:
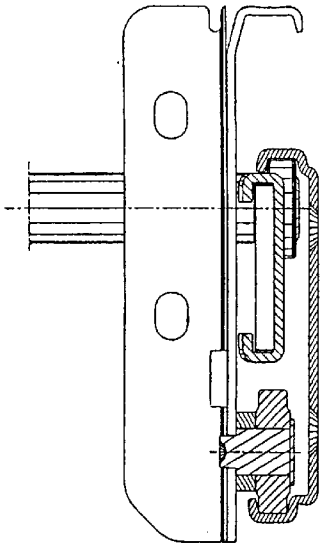
FIG. 7 is a sectional view along line A—A in FIG. 5.
Figure 6:
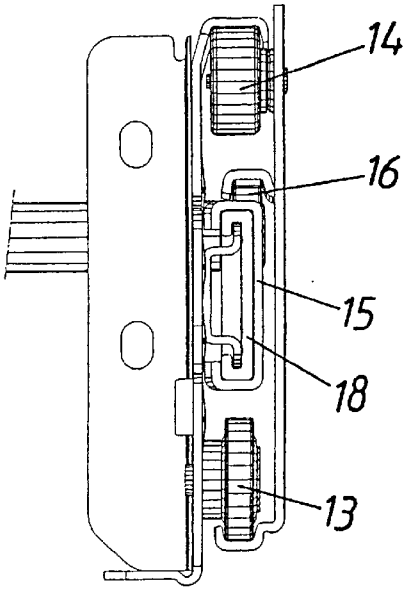
FIG. 6 is a view in the direction indicated by X FIG. 5.
Figure 5:
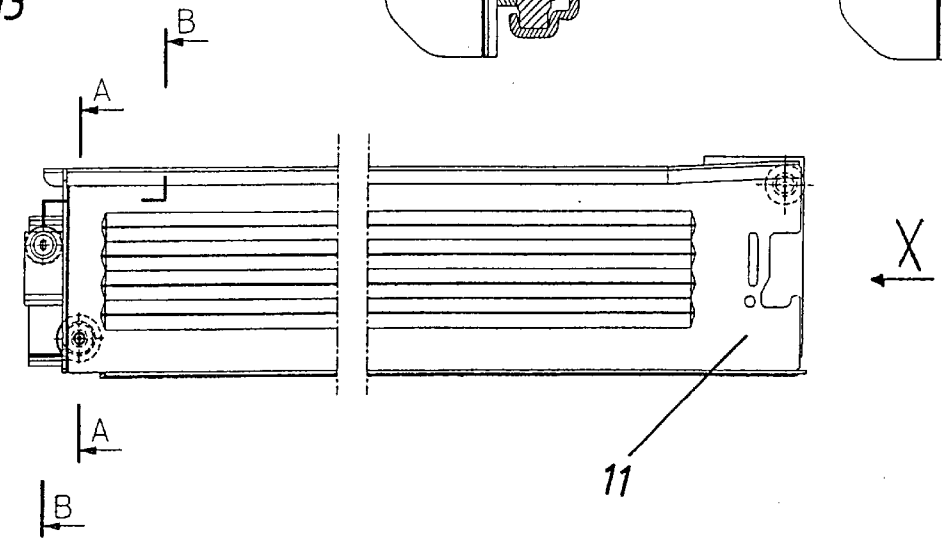
FIG. 5 is a side view of this further embodiment.

FIG. 3 shows a dismantled running roller 3, with a directly connected receiving pin 5 and an associated connecting rod 7. In this embodiment the connecting rod 7 is fixed on both its sides by a wedge connection 6 to respective running rollers 3 by virtue of pins 5 in a manner preventing rotation. The connection between the running rollers 3 can be made in any manner desired, for example by way of pins or couplings, provided that the connection made in a manner preventing rotation. A tube can also be provided instead of a rod.

Running rollers 16 of the intermediate rails 15 are connected to each other in a non-rotational manner by a shaft 20, as a result of which lateral stability as in the embodiment described above is achieved. When the drawer is pulled out from a furniture body, running rollers 13 of the drawer rails 11 first roll on lower horizontal webs 12*c* of the body rails 12. With a specific pull-out path the drawer tilts about support rollers 14, and the running rollers 16 of the intermediate rails 15 roll on upper horizontal webs 12*c* of the body rails 12. In this case, the running rollers 13 of the drawer rails 11 are unstressed in a front pull-out path.

What is claimed is:

1. A pull-out guide assembly for a drawer, comprising:

a first body rail to be fixed to a furniture body and positioned on a first side of a drawer, and a second body rail to be fixed to the furniture body and positioned on a second side of the drawer, said first and second body rails each having a U-shaped section including an upper web and a lower web;

a first moveable rail to be positioned on the first side of the drawer and a second moveable rail to be positioned on the second side of the drawer;

a first support roller mounted on said first body rail and a second support roller mounted on said second body rail;

a first running roller mounted on said first moveable rail and a second running roller mounted on said second moveable rail, said first running roller being adapted to be guided by said U-shaped section of said first body rail so as to run on said upper web or said lower web of said U-shaped section of said first body rail, and said second running roller being adapted to be guided by said U-shaped section of said second body rail so as to run on said upper web or said lower web of said U-shaped section of said second body rail, wherein said first running roller and said second running roller are non-rotationally connected to each other.

2. The pull-out guide assembly according to claim 1, wherein said first moveable rail and said second moveable rail each include (i) a drawer rail to be mounted on the drawer, and (ii) an intermediate rail situated between said drawer rail and a respective one of said first and second body rails, and said first running roller is mounted on said intermediate-rail of said first moveable rail, and said second running roller is mounted on said intermediate rail of said second moveable rail.

3. The pull-out guide assembly according to claim 2, further comprising a third running roller mounted on said drawer rail of said first moveable rail, and a fourth running roller mounted on said drawer rail of said second moveable rail.

4. The pull-out guide assembly according to claim 3, wherein said first running roller is adapted to be guided by said U-shaped section of said first body rail so as to run on said upper web of said U-shaped section of said first body rail, said second running roller is adapted to be guided by said U-shaped section of said second body rail so as to run on said upper web of said U-shaped section of said second body rail, said third running roller is adapted to be guided by said U-shaped section of said first body rail so as to run on said lower web of said U-shaped section of said first body rail, and said fourth running roller is adapted to be guided by said U-shaped section of said second body rail so as to run on said lower web of said U-shaped section of said second body rail.

5. The pull-out guide assembly according to claim 1, wherein said first running roller is adapted to be guided by said U-shaped section of said first body rail so as to alternately run on said upper web and said lower web of said U-shaped section of said first body rail, and said second running roller is adapted to be guided by said U-shaped section of said second body rail so as to alternately run on said upper web and said lower web of said U-shaped section of said second body rail.

6. The pull-out guide assembly according to claim 1, wherein said first running roller and said second running roller are non-rotationally connected to each other via a rod that interconnects said first running roller and said second running roller.

7. The pull-out guide assembly according to claim 1, wherein said first running roller and said second running roller are non-rotationally connected to each other via a tube that interconnects said first running roller and said second running roller.

8. The pull-out guide assembly according to claim 1, wherein provided on a running face of said first running roller is a gripping-assisting surface, and provided on a running face of said second running roller is a gripping-assisting surface.

9. The pull-out guide assembly according to claim 1, wherein said first and second moveable rails comprise drawer rails to be mounted on the drawer.

10. The pull-out guide assembly according to claim 1, further comprising a third running roller mounted on said first moveable rail and a fourth running roller mounted on said second moveable rail.

11. The pull-out guide assembly according to claim 10, wherein said first running roller is adapted to be guided by said U-shaped section of said first body rail so as to run on said upper web of said U-shaped section of said first body rail, said second running roller is adapted to be guided by said U-shaped section of said second body rail so as to run on said upper web of said U-shaped section of said second body rail, said third running roller is adapted to be guided by said U-shaped section of said first body rail so as to run on said lower web of said U-shaped section of said first body rail, and said fourth running roller is adapted to be guided by said U-shaped section of said second body rail so as to run on said lower web of said U-shaped section of said second body rail.

* * * * *